United States Patent [19]

Zander

[11] 3,993,107

[45] Nov. 23, 1976

[54] METHOD OF MANUFACTURING BENT FILAMENTS AND DEVICE FOR CARRYING OUT THE SAID METHOD

[75] Inventor: Georg Zander, Stolberg, Germany

[73] Assignee: U.S. Philips Corporation, New York, N.Y.

[22] Filed: Mar. 19, 1975

[21] Appl. No.: 559,822

[30] Foreign Application Priority Data

Mar. 22, 1973 Germany ..... 2413791

[52] U.S. Cl. ..... 140/71.5; 72/149

[51] Int. Cl.[2] ..... B21F 45/00

[58] Field of Search ..... 140/71.5, 71.6; 72/149, 72/154; 29/610, 611

[56] References Cited

UNITED STATES PATENTS

| | | | |
|---|---|---|---|
| 1,214,551 | 2/1917 | Karpouich | 72/149 |
| 1,733,802 | 10/1929 | Higgins | 140/71.6 |
| 3,048,201 | 8/1962 | Johnson | 140/71.5 |

*Primary Examiner*—Lowell A. Larson
*Attorney, Agent, or Firm*—Frank R. Trifari

[57] ABSTRACT

A method of manufacturing bent filaments for incandescent lamps, a core-free filament is seized by its ends. The front end is moved around a mandril which is driven in accordance with the filament bending speed, while the rear end of the filament is moved in a straight line in the direction of the original filament axis.

6 Claims, 1 Drawing Figure

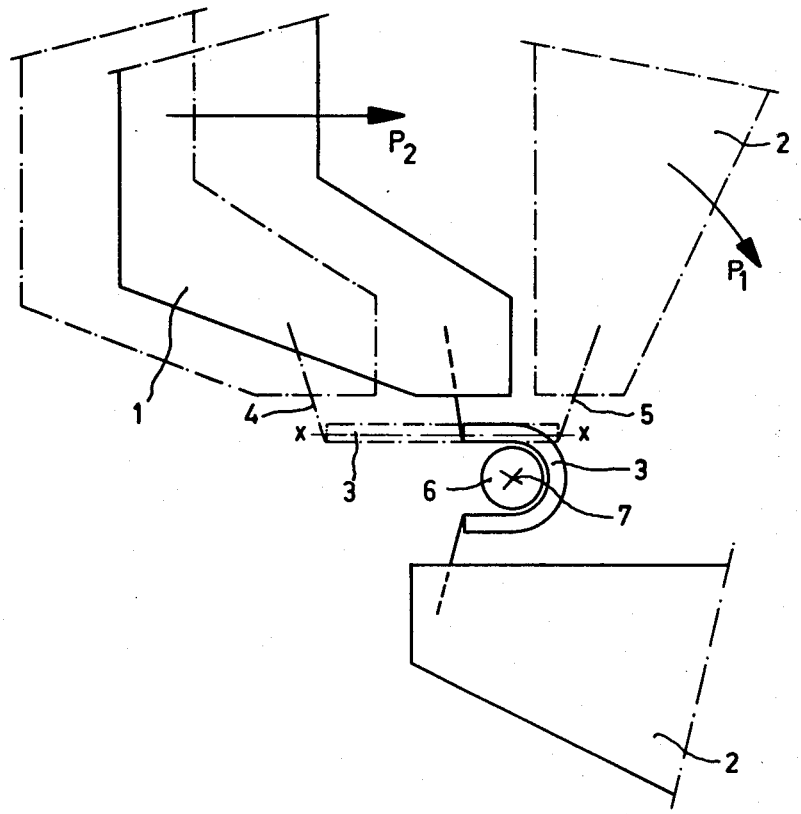
P2
2
P1
1
4
x
x
5
3
3
6
7
2

METHOD OF MANUFACTURING BENT FILAMENTS AND DEVICE FOR CARRYING OUT THE SAID METHOD

The invention relates to a method of manufacturing bent filaments for electric incandescent lamps in which an initially straight filament is bent around a mandril and is then annealed.

In many incandescent lamps, for example projection lamps or motor-car lamps, bent filaments are required, in particular filaments bent in the form of a U. The filaments usually consist of tungsten wire and may be in the form of a coiled filament or a coiled coil filament.

In the known methods of manufacturing such bent filaments, the filament is first either wound on a core wire or a core wire is inserted into the straight filament drawn from the winding mandril (French patent specification No. 1,135,579). Together with the core wire the filament is then bent into the desired shape. However, the pitch of the individual turns of the filament become considerably smaller on the inside of the bend than on the outside, so that the danger exists that the mutual distance between the individual turns becomes irregular and that the turns even contact each other partly so that short-circuit occurs in said places and the filament fuses. In order to avoid said drawbacks it is already known to provide the core wire which is to be inserted into the straight filament with projections to ensure the desired smallest distance between the turns of the bent filament (Austrian patent specification No. 217,567). The said core wire is afterwards removed again by etching, that is to say dissolving in acid.

Furthermore, a method of manufacturing filaments is known in which the tungsten wire is wound on a core wire and, in order to reach a uniform filament pitch, an auxiliary wire is also wound which is arranged between the individual turns of the filament and whose thickness corresponds to the desired pitch height. After bending and annealing the filament, the core wire as well as the auxiliary wire are etched away. These methods are cumbersome and expensive and require at least one core wire which is to be removed chemically afterwards.

It is the object of the invention to provide a method of manufacturing bent filaments in which the starting material is a core-free straight filament and in which a bent filament is obtained substantially without pitch errors. Core-free filaments have so far been deformed in a kind of compression process in which, however, considerable pitch errors occurred.

According to the invention, this object is achieved in a method of the type mentioned in the preamble in that the core-free straight filament is seized by its ends and is wound with its front end around the mandril which is driven in accordance with the filament bending speed, while the rear end of the filament is moved in a straight line in the direction of the original filament axis.

Since the bending mandril together with the front end of the filament rotate at the same angular speed, substantially no friction occurs between the filament to be bent and the mandril so that the uniform distance of the individual turns mutually is maintained, although no core wire is present in the filament.

Whereas in the known methods the bent filaments which have a core wire are removed from the bending device after the bending operation and are annealed in a separate annealing oven, the annealing in the method according to the invention of the bent filaments is carried out immediately after the bending operation on the bending device. This results in a further simplification and inexpensiveness of the overall manufacturing method.

It is to be noted that the method according to the invention can be used in any type of filament, whether the ends of the filaments extend in the direction of the axis of the filament or at an angle to the axis of the filament.

The invention also relates to a device for carrying out the described method. This device is characterized in that two tongs are present to seize the ends of the core-free straight filament, of which the foremost tongs having the filament can be moved together with the foremost tongs around a mandril which is driven in accordance with the filament bending speed, while the rear tongs are moved in the longitudinal direction of the original straight filament axis.

In order that the annealing of the bent filaments can be done on the bending device, the two tongs are preferably constructed in the form of contact tongs.

In order to avoid adhering of the heated filament to the bending mandril during the annealing operation, the said mandril preferably consists of a non-metallic material, in particular ceramic.

The invention will now be described in greater detail with reference to an embodiment shown in the drawing.

The FIGURE shows diagrammatically the most important parts of a device according to the invention in which the initial position of the device with the filament which is still straight is shown in dot-and-dash lines and the final position with the U-shaped bent filament is shown in solid lines.

Reference numerals 1 and 2 denote two tongs which are arranged so as to be insulated and which seize the initially straight filament 3 by its ends 4 and 5. The axis of the straight filament is denoted by X—X. The tongs 2 can be rotated together with a ceramic mandril 6, for example of $Al_2O_3$, about an axis 7 in the direction of the arrow $P_1$, in that both parts are arranged, for example, on a common disc which is not shown and which is rotatable about the axis 7, namely the mandril 6 in its rotary centre and the tongs 2 in its peripheral region. Upon rotating the disc the tongs 2 take along the front end 5 of the filament 3 and turns it about the mandril 6 which is automatically driven in accordance with the filament bending speed. During the bending operation the rear tongs 1 with the rear end 4 of the filament 3 are moved in a straight line in the direction of the filament axis X—X in the direction of the arrow $P_2$. After the bending operation, the tongs 1 and 2 as well as the filament 3 have assumed the positions shown in solid lines.

Subsequently the bent filament 3 is heated by applying an electric voltage to the contact tongs 1 and 2 and is annealed under a protective gas atmosphere in which it is annealed so as to be stress-free. As a result of this and due to the automatic travel of the mandril 6 together with the foremost tongs 2 during the actual bending operation, a bent stress-free filament 3 has been obtained which shows substantially no pitch errors.

I claim:

1. A method of manufacturing bent filaments for electric incandescent lamps which comprises: providing an initially straight core-free coiled filament having a first end and a back end and an initially straight axis, bending said filament by seizing the ends thereof and contemporaneously (1) bending said front end around said mandril, (2) driving said mandril in accordance with the filament bending speed; and moving the rear end of the filament in a straight line in the direction of said initially straight filament axis.

2. A method as claimed in claim 1 further including the step of annealing the bent filament immediately after said bending step.

3. The method as described in claim 1 wherein said coiled filament is formed of a coil whereby said filament is a coiled coil.

4. A device for manufacturing bent filaments which comprises: first and second tongs each tong including means to seize one end of an initially straight filament, a mandril, means for moving said first tongs around said mandril, means for driving said mandril in accordance with the filament bending speed and moving said second tongs in the longitudinal direction of the original straight filament axis.

5. A device as claimed in claim 4 wherein said mandril is a non-metallic material, preferably ceramic.

6. A device as claimed in claim 5 wherein said non-metallic material is ceramic.

* * * * *